United States Patent [19]

DuBois

[11] 4,336,123

[45] Jun. 22, 1982

[54] ELECTROLYTIC APPARATUS UTILIZING A TRANSITION METAL-GRAPHITE INTERCALATION COMPOUND CATHODE

[75] Inventor: Donald W. DuBois, Corpus Christi, Tex.

[73] Assignee: PPG Industries, Inc., Pittsburgh, Pa.

[21] Appl. No.: 233,735

[22] Filed: Feb. 12, 1981

Related U.S. Application Data

[62] Division of Ser. No. 165,995, Jul. 7, 1980, Pat. No. 4,282,074.

[51] Int. Cl.[3] ..... C25B 9/00; C25B 11/04; C25B 11/12

[52] U.S. Cl. ..... 204/252; 204/282; 204/290 R; 204/294

[58] Field of Search ..... 204/252–253, 204/294, 290 R, 282

[56] References Cited

U.S. PATENT DOCUMENTS 3,536,532 10/1970 Watanabe et al. ..... 136/83
4,052,539 10/1977 Shropshire et al. ..... 429/194
4,074,019 2/1978 Malachesky et al. ..... 429/50
4,135,995 1/1979 Welch ..... 204/98

OTHER PUBLICATIONS

Rudorf et al., Reactions of Graphite with Metal Chlorides, Angew. Chem. Inter. Ed., vol. 1 (1963), pp. 67–73.

Rudorf, Graphite Intercalation Compounds Advances in Inorganic Chem. and Radiation, vol. 1, pp. 223–266.

Henning, Interstitial Compounds of Graphite, Progress in Inorganic Chemistry, vol. 1, pp. 125–205.

A. R. Ubbeholde et al., Graphite and Its Crystal Compounds, 1960.

*Primary Examiner*—R. L. Andrews

*Attorney, Agent, or Firm*—Richard M. Goldman

[57] ABSTRACT

Disclosed is a method of electrolyzing an alkali metal chloride brine where the cathode is an intercalation compound of graphite and a transition metal. Also disclosed is a solid polymer electrolyte having as its cathode an intercalation compound of graphite and a transition metal, and an electrolytic cell having as its cathode an intercalation compound of graphite and a transition metal.

16 Claims, No Drawings

ELECTROLYTIC APPARATUS UTILIZING A TRANSITION METAL-GRAPHITE INTERCALATION COMPOUND CATHODE

This is a division of application Ser. No. 165,995, filed July 7, 1980 now U.S. Pat. No. 4,282,074.

DESCRIPTION OF THE INVENTION

In the process of producing aqueous alkali metal hydroxide and chlorine by electrolyzing an alkali metal chloride brine, i.e., an aqueous solution of sodium chloride or an aqueous solution of potassium chloride, the alkali metal chloride brine is fed into the anolyte compartment of an electrolytic cell, a voltage is imposed to cross the cell, chlorine is evolved at the anode, alkali metal hydroxide is produced in the electrolyte in contact with the cathode, that is, the catholyte, and hydrogen may be evolved at the cathode.

The overall anode reaction is $$2Cl^- \rightarrow Cl_2 + 2e^- \quad (1)$$

while the overall cathode reaction is $$2H_2O + 2e^- \rightarrow H_2 + 2OH^- \quad (2)$$

More precisely, the cathode reaction is reported to be $$H_2O + e^- \rightarrow H_{ads} + OH^- \quad (3)$$

by which the monatomic hydrogen is adsorbed onto the surface of the cathode. In aqueous alkali media, the adsorbed hydrogen is reported to be desorbed according to one of two alternative processes;

$$2H_{ads} \rightarrow H_2, \text{ or} \quad (4)$$

$$H_{ads} + H_2O + e^- \rightarrow H_2 + OH^{31} \quad (5)$$

The hydrogen overvoltage controlling steps are variously reported in literature to be mass transfer effects connected with the electron transfer equation (3), that is, the movement of hydroxyl ion away from the electrode surface, and the hydrogen desorption step, i.e., reaction (4) or reaction (5).

That is, it is these rate controlling steps and the activation energies associated therewith that correspond to the cathodic hydrogen overvoltage. The cathode voltage for the hydrogen evolution reaction (2) is on the order of about 1.5 to 1.6 volts versus a saturated calomel electrode (S.C.E.) on iron in basic media, of which the hydrogen overvoltage component is about 0.4 to 0.5 volt.

One method of reducing the cathode overvoltage associated with the mass transfer effects of reaction (3) is to provide increased cathodic surface area. That is, the hydrogen overvoltage contribution associated with the mass transfer of reaction (3) may be reduced by providing a porous, high surface area cathode, as a porous graphite cathode.

It has now been found, however, that a particularly desirable porous carbon cathode useful in carrying out reactions in aqueous alkali media is provided by a solid intercalation compound of carbon and a transition metal.

DETAILED DESCRIPTION OF THE INVENTION

Disclosed herein is an electrolytic cell intended for the electrolysis of alkali metal chloride brines, that is, aqueous alkali metal chloride solutions, such as aqueous sodium chloride solutions and aqueous potassium chloride solutions. The electrolytic cell herein contemplated has an anode and a cathode with an ion permeable separator therebetween. The ion permeable separator may be an electrolyte permeable diaphragm, for example an asbestos diaphragm as exemplified by both preformed asbestos diaphragms and deposited asbestos diaphragms, including resin reinforced asbetos diaphrams, e.g., sintered resin or thermoplastic resin reinforced asbestos diaphragms. Alternatively the electrolyte permeable diaphragm may be a diaphragm of a synthetic microporous material. According to a still further exemplification of this invention, the separator may be an electrolyte impermeable, but ion permeable separator, that is, a permionic membrane. The permionic membranes useful in the electrolytic cell herein contemplated are perfluorinated hydrocarbons having cation selective groups, as carboxylic groups of sulfonyl groups.

The electrodes may be spaced from the separator, they may contact the separator, they may be deformably, compressively, and removably in contact with the separator, as in one form of a solid polymer electrolyte electrolytic cell, or they may be bonded to and embedded in the electrolyte impermeable, ion permeable separator, as in a solid polymer electrolyte.

The electrolytic cell herein contemplated is characterized by having a cathode that is an intercalation compound of graphite and a transition metal.

According to an alternative exemplification of this invention, there is provided a solid polymer electrolyte having as its cathode, an intercalation compound of graphite and a transition metal. The solid polymer electrolyte is comprised of a permionic membrane, that is, a fluorocarbon polymer sheet having cation selective groups, e.g., either carboxylic acid groups of sulfonyl groups, pendent thereto. The cation selective groups may be in equal concentrations on both sides of the permionic membrane, or in higher concentration of cation selective groups on the anodic side of the permionic membrane, and a lower concentration of cation selective groups on the cathodic side of the permionic membrane.

In the solid polymer electrolyte herein contemplated, the electrodes may compressively, deformably, and removably bear upon the permionic membrane. That is, the electrode or electrodes are separate units, neither bonded to nor embedded in the permionic membrane, but compressively bearing upon the permionic membrane so as to substantially preclude electrolytic transfer between the permionic membrane and the electrode.

That is, the intercalation compound of graphite and the transition metal may compressively bear upon the permionic membrane. For example, the intercalation compound of graphite and the transition metal may be deposited on a substrate whereby to provide from about 0.1 to about 10 milligrams or more of the transition metal per square centimeter of permionic membrane.

Alternatively, the cathode elements, that is, the particles of the intercalation compound, may be bonded to and embedded in the permionic membrane.

As herein contemplated, the cathode in an intercalation compound of graphite and a transition metal. The intercalation compound may be bonded to and embedded in the permionic membrane, for example, by hot pressing the particles into a molten, softened, or otherwise plastic form of the permionic membrane. In this way, there is provided a thin layer or film, that is, from about 0.01 millimeters to about 1 millimeter thick, providing from about 0.1 to about 10 milligrams or more of transition metal per square centimeter of permionic membrane.

According to a still further exemplification of this invention, there is provided a method of conducting electrolysis. As herein contemplated, an alkali metal chloride brine is electrolyzed to produce chlorine. The reaction is carried out by feeding brine, i.e., aqueous potassium chloride, or aqueous sodium chloride, to the anolyte compartment of an electrolytic cell. The cell has an anode in the anolyte compartment, a cathode in the catholyte compartment, and a separator therebetween, which separator may be either electrolyte permeable, or electrolyte impermeable but cation permeable. The electrode-separator relationship may be conventional, with a film of electrolyte between the permionic membrane or diaphragm and the active electrode area, such as where a diaphragm rests on the surface of the cathode, but the bulk of the cathodic reaction occurs on the surface of the cathode remote from the diaphragm. Alternatively, the electrode-separator configuration may be zero-gap, as in a solid polymer electrolyte where the electrode compressively bears upon a permionic membrane so as to minimize the amount of electrolyte between the permionic membrane and the electrode and thereby to substantially preclude the existence of a film of electrolyte between the permionic membrane and the electrode. According to a still further exemplification of this invention, the cathode may be bonded to and embedded in the permionic membrane, as in a solid polymer electrolyte configuration.

Electrical current passes from the anode to the cathode evolving chlorine at the anode according to reaction $$2Cl^- \rightarrow Cl_2 + 2e^- \quad (1)$$

and hydroxyl ion at the cathode $$H_2O + e^- \rightarrow OH^- + HO \quad (2)$$

which nascent hydrogen $H_1^{\circ}$ may be depolarized by reaction with an oxidant whereby to form water, or may evolve as gas.

According to the method herein contemplated, the cathode is an intercalation compound of a transition metal and graphite.

By an intercalation compound of graphite and a transition metal is meant carbonaceous material crystallized in a graphitic layer lattice and having transition metal or compounds thereof between the layers, lamina, or lamella of the lattice.

As herein contemplated, the transition metal of the graphite and transition metal intercalation compound may be introduced into the graphite as a halide salt, nitrate salt, carbonate salt, or sulfate salt thereof and is believed to be present within the graphite as a transition metal or coordination compound thereof with the graphite, or as a co-ordination compound of a transition metal chloride, fluoride, or oxide with the graphite.

The transition metal intercalation compounds herein contemplated are prepared by reacting a transition metal or a salt thereof with graphite under conditions which result in the formation of the intercalation compound. The salts useful in forming the intercalation compounds include halides, nitrates, sulfates, and carbonates. Alternatively, the oxides may be used. Especially preferred are those salts having mono-atomic anions, e.g., halide anions. Preferred halides are fluorides and chlorides. Especially preferred due to convenience in synthesis and handling are chlorides.

The graphitic layer lattice of the intercalation compound is characterized by layers, lamina or lamella of carbon macromolecules retaining an aromatic structure in which the carbon atoms thereof are approximately 1.41 angstroms apart. In the contemplated intercalation compound, the layers, lamina, or lamella of the carbon macromolecule are stretched apart by the intercalated transition metal or transition metal compound, i.e., transition metal chloride, sulfate, nitrate, or carbonate. That is, the carbon layers, lamina, or lamella are spaced wider apart than the 3.35 angstroms characteristic of graphite. The vertical distances between adjacent layers of the intercalation compounds useful herein are in excess of 3.35 angstroms, i.e., from about 6 to 7 angstroms where a transition metal is intercalated in the graphite, and from about 9 to 10 angstroms, generally from about 9.4 to 9.6 angstroms when a transition metal salt is intercalated within the graphite. While a transition metal salt is spoken of, it is believed that the anion of the salt may not be present within the graphite lattice, and that the cation, i.e., the metal, may be present as a metal, an ion, or a co-ordination compound with the graphite or with oxygen, chlorine, of fluorine, i.e., as an oxide, chlorine, or fluoride intercalated with the graphite, e.g., as a co-ordination compound.

The transition metals that are useful in the practice of this invention include chromium, manganese, iron, cobalt, nickel, copper, yttrium, zirconium, niobium, molybdenum, technectium, ruthenium, rhodium, palladium, silver, cadmium, hafnium, tantalum, tungsten, rhenium, osmium, iridium, platinum, gold, mercury, and thallium, as their stable oxidation states.

Especially preferred because of ease of synthesis and catalytic activity are intercalation compounds of graphite with chromium, iron, cobalt, nickel, copper, zirconium, molybdenum, ruthenium, rhodium, palladium, hafnium, tantalum, tungsten, rhenium, platinum, gold, and mercury. Preferred precurser compounds are the highest oxidation states of the transition metals, for example, chromium, $CrCl_3$, and $CrO_3$, iron and iron trichloride, cobalt and cobalt dichloride, nickel and nickel dichloride, copper and copper dichloride, zirconium and $ZrCl_4$, molybdenum and $MoCl_5$, ruthenium and $RuCl_3$, rhodium and $RhCl_3$, palladium and $PdCl_4$ and $PdCl_2$, hafnium and $HfCl_4$, tantalum and $TaCl_5$, tungsten and $WCl_6$, rhenium and $ReCl_4$, platinum and $PtCl_4$, gold and $AuCl_3$, and mercury and $HgCl_2$.

The intercalation compounds herein contemplated may be prepared by the methods described and enumerated in J. M. Lalancette et al, Canadian Journal of Chem., volume 54 (1976), page 2505, in R. C. Croft, *New Molecular Compounds of the Layer Lattice Type, I. New Molecular Compounds of Graphite*, Australian J. Chemical, volume 9 (1956) page 184, in Rudroff et al, *Reactions of Graphite With Metal Chlorides*, Angew. Chem. Internat. Edit., volume 2 (1963), number 2, page 67, and may be commercially obtained from the Alfa Division of Ventron Corporation, under the trade designation "Graphimet".

The amount of transition metal basis the metal in the intercalation compound is from about 0.5 weight percent to about 25 weight percent. The transition metal may be present as a metal, i.e., without fluorine, chlorine, or oxygen, and co-ordinated with the graphitic carbon. Alternatively, the transition metal may be present as an oxide, fluoride, or chloride that may also be co-ordinated with the graphitic carbon. When so present, the content of transition metal is from 0.5 to about 25 weight percent, although the total amount of intercalate may be greater, i.e., up to 40, or more percent of the total intercalation compound.

For example, when the transition metal is cobalt it may be present in the metallic state up to about 30 weight percent, or as the chloride from about 5 to about 55 weight percent. When the transition metal is copper, it may be present in the metallic state from up to about 20 weight percent, or as the chloride up to about 50 weight percent. When the transition metal is chromium, it may be present up to about 50 weight percent as the metal, or up to about 75 weight percent, as the chloride $CrCl_3$, the oxychloride $CrO_2Cl_2$, or the oxyfluoride $CrO_2F_2$. When the transition metal is iron, it may be present up to about 40 weight percent as the elemental metal, or up to about 55 weight percent as $FeCl_3$. When the transition metal is nickel it may be present up to about 20 weight percent as the metal, or up to about 50 weight percent, as the chloride. When the transition metal is palladium, it may be present up to about 40 weight percent as the metal, or up to about 54 percent $PdCl_2$. When the transition metal is platinum, it may be present up to about 25 weight percent as the elemental metal, or up to about 40 weight percent, as $PtCl_4$. When the transition is rhodium, it may be present at up to about 25 weight percent as the elemental metal, or up to about 40 weight percent as rhodium trichloride. When the transition metal is ruthenium, it may be present up to about 25 weight percent as the metal or up to about 40 weight percent as $RuCl_3$.

The physical form of the intercalation compound may be a fine powder, a coarse powder, irregular particles, pressed pellets, or monolithic graphite. Alternatively, it may be present as an extrudate or sintered product.

The intercalation compound may be hot pressed into a permionic membrane, for example, hot pressed into a thermoplastic form of the permionic membrane as an ester of a carboxylic acid permionic membrane, a sulfonyl chloride membrane, or a sulfonyl fluoride permionic membrane. Alternatively, it may be sintered, as sintering with polytetrafluorethylene.

According to a still further exemplification, a liquid composition may be prepared containing the intercalation compound of graphite and the transition metal, a small amount of surfactant, water, and an emulsion of polyperfluorethylene resin in water. The intercalation compound, the surfactant, and the water are first mixed together to form a slurry. Thereafter, the polyperfluorethylene may be added thereto, whereby to form a sludge which may be deposited on the permionic membrane or the catalyst carrier. After deposition of the material on the permionic membrane or catalyst carrier, the sludge, paste, or slurry may be dried and compressed whereby to cause the intercalation compound and binder to adhere thereto. The drying may be carried out at a temperature high enough to drive off any solvents such as water or organic liquids which may be present. This provides some porosity. Typically, the temperatures required is from about 100° C. to about 350° C.

Typical solvents which may be used in preparing the cathodic catalysts as described above include water, methanol, ethanol, dimethylformamide, propylene glycol, acetonitrile and acetone among others.

Where the intercalation compound is deposited on a catalyst carrier, the catalyst carrier is typically, when a zero-gap solid polymer electrolyte type cell is to be used, a mesh of from about 20 to about 100 mesh (U.S. Standard) of 2 to 20 mil diameter wire having about 40 to 80 percent open area. Alternatively, when the intercalation compound is to be spaced from the permionic membrane or diaphragm, a more coarse catalyst carrier may be utilized.

The intercalation herein contemplated may be the only cathodic electrocatalyst present, that is, catalyzing the reaction $$H_2O+2e^- \rightarrow H_{1O}+OH^- \quad (2)$$

Alternatively, the intercalation compound may be admixed with or in combination with other catalysts, in which case the cathodic reaction is $$O_2+2H_2O+4e^- \rightarrow 4OH^- \quad (6)$$

which is actually the reaction $$O_2+H_2O+2e^- \rightarrow HO_2^- + OH^- \quad (7)$$

followed by the reaction $$2HO_2^- \rightarrow O_2+2OH^- \quad (8)$$

The reaction (8) $2HO_2^- \rightarrow O_2+2OH^-$ is catalyzed by $HO_2^-$ disproportionation catalysts. Typical catalysts include the transition metals of group VIII, i.e., iron, cobalt, nickel, palladium, ruthenium, rhodium, platinum, osmium, and compounds thereof, such as the intercalated chlorides thereof. Additionally, solid metaloids, such as thalocyanines of group VIII metals, spinels, delaphosphites, and pyrochlors, among others, may be used as a catalytic surface upon the external surface and within the pores of the intercalation compound.

The intercalation compound itself may function as both an electron transfer catalyst and an $HO^-{}_2$ disproportionation catalyst when an oxidant, as oxygen, is fed to the cathodic compartment of the electrolytic cell.

According to one exemplification of the invention herein contemplated, chlorine platinic acid, $H_2PtCl_6$-$6H_2O$ may be dried and mixed with ground graphite, maintaining anhydrous conditions throughout the grinding and mixing. Thereafter the dried, ground solids are heated, e.g., to above about 200° Centigrade, and preferably to between about 215° Centigrade to about 230° Centrigrade in a chlorine atmosphere. Preferably the chlorine atmosphere is a dry chlorine atmosphere, with dry chlorine being introduced and moist chlorine being removed. The reaction is carried out for at least about 2 hours, and preferably for at least about 6 hours.

It is believed that the chloroplatinic decomposes to $PtCl_4$, with HCl and water being formed and drawn off, and the subsequent formation of a $PtCl_4$-graphite intercalation compound.

The resulting product, an intercalation compound of graphite and $PtCl_4$, is ground under an inert atmosphere, e.g., nitrogen, washed, and dried. Washing may be with dilute hydrochloric acid, water, and an organic solvent, either individually or sequentially. In this way there is produced an intercalation compound containing 10 to 20 weight percent platinum.

The resulting particles may then be utilized as a cathode, e.g., by hot pressing onto the cathodic surface of a perfluorinated carboxylic acid permionic membrane. Preferably the membrane is an ethyl ester and hot pressing is carried out at a temperature of 180° to 225° C. The particle loading should be such as to obtain a platinum loading of 0.5 to 2.5 grams of platinum, calculated as the metal, per square centimeter of membrane. Thereafter the membrane may be hydrolyzed, e.g., in caustic soda, and installed in a cell.

Cathode potentials of cathodes prepared as described above range downward from 1.46 volts versus a silver-silver chloride reference electrode in saturated KCl for a 1 percent platinum compound electrode, to less than about 1.35 volts for cathodes containing about 25 weight percent PtCl, to less than 1.27 volts for cathodes containing about 16 weight percent platinum.

Cathode potentials of cathodes prepared by intercalating nickel into graphite are about 1.48, measured as described above, for cathodes containing 15 weight percent nickel.

While the mechanism of the transition metal-graphite intercalation compound catalyzed reaction is not fully understood, it is believed that the transition metal expands the interplanar distance to about 6 to 7 angstroms in the case of an intercalated metal, and from about 9 to 10 angstroms in the case of an intercalated chloride or oxide. This enhanced interplanar spacing allows the diffusion of water into expanded graphite lattice where the electron transfer reaction, and, where appropriate, the $HO^-{}_2$ disproportionation reaction, is catalyzed by the transition metal or chloride thereof.

It is further believed that there is some coordination of the transition metal or chloride, fluoride, or oxide thereof with the carbon, possibly forming the coordination compound similar to the coordination compounds of cyclopentadiene with transition metals. It is believed that this coordination compound may catalyze a step in cathode reaction.

The following example is illustrative.

EXAMPLE

A solid polymer electrolyte electrolytic cell having a cathode of an itercalation compound of platinum and graphite was prepared and used to electrolyze sodium chloride brine.

A solid polymer electrolyte was prepared by hot pressing 0.7 grams of Alfa Graphimet (TM) Pt-1, an intercalation compound of 1 weight percent platinum in graphite onto a 9 square inch by 11 mil thick Asahi Glass Co. Ltd. FLEMION (TM) HB perfluorocarbon carboxylic acid permionic membrane. The membrane was in the ethyl ester form, and hot pressing was at a temperature of 200 degrees Centigrade, and a pressure of 3 kilograms per square centimeter for 1 minute. The resulting solid polymer electrolytecathode unit had a cathodic surface approximately 0.06 millimeters thick, containing 12 milligrams per square centimeter of carbon and 0.12 milligrams per square centimeter of platinum.

The solid polymer electrolyte-cathode unit was installed in a laboratory electrolytic cell. The cell anode was a ruthenium dioxide-titanium dioxide coated titanium fine mesh having 16 strands of 0.01 centimeter diameter per centimeter, and approximately 70 percent open area. The anode was pressed against the membrane, deforming he surface thereof, by a ruthenium dioxide-titanium dioxide coated titanium coarse mesh having 1 strand per centimeter of 0.16 centimeter diameter titanium wire, and approximately 50 percent open area.

The cathode current collector was a fine nickel mesh having 14 strands per centimeter of 0.01 centimeter diameter nickel, and an open area of about 70 percent. The cathode current collector was pressed against the graphite-platinum intercalation compound film, deforming the membrane surface.

Electrolysis was carried out at a temperature of 90 degrees Centigrade, and a current density of 395 amperes per square foot. During 38 days of electrolysis, the cell voltage was 3.71 volts, the cathode potential was 1.46 volts, the catholyte contained 35.9 to 37.9 weight percent sodium hydroxide and 0.002 to 0.009 sodium chloride on an anhydrous sodium chlorate basis, the anode potential was 1.10 to 1.21 volts, the oxygen content of the chlorine was 6.1 to 6.9 volume percent, the anode efficiency was 86.4 to 88.3 percent, and the cathode efficiency was 87.5 to 90.7 percent.

Although this invention has been described with respect to certain specific exemplifications and embodiments, it is not intended to be so limited except as appears in the attached claims.

I claim:

1. In an electrolytic cell for the electrolysis of aqueous electrolytes having an anode, a cathode, and an electrolyte impermeable, cation permeable permionic membrane comprising fluorocarbon polymer having cation selective groups pendant thereto therebetween, the improvement wherein the cathode comprises an intercalation compound comprising graphite and a transition metal component.

2. The electrolytic cell of claim 1 wherein the transition metal component is chosen from the group consisting of metals and salts thereof.

3. The electrolytic cell of claim 2 wherein the transition metal component is chosen from the group consisting of copper, cadmium, mercury, cobalt, gold, iron, chromium, ruthenium, rhodium, zirconium, hafnium, rhenium, palladium, platinum, iridium, tantalum, molybdenum, tungsten, salts thereof, and mixtures thereof.

4. The electrolytic cell of claim 3 wherein the transition metal component is chosen from the group consisting of Co, $CoCl_2$, Cu, $CuCl_2$, Cr, $CrCl_3$, Fe, $FeCl_3$, Ni, $NiCl_2$, Pd, $PdCl_2$, Pt, $PtCl_4$, Rh, $RhCl_3$, Ru, $RuCl_3$, Ir, $IrCl_4$, and mixtures thereof.

5. The electrolytic cell of claim 1 wherein the cathode is spaced from the permionic membrane with electrolyte therebetween.

6. The electrolytic cell of claim 1 wherein the cathode is in contact with the permionic membrane.

7. The electrolytic cell of claim 6 wherein the cathode compressively bears upon the permionic membrane.

8. The electrolytic cell of claim 6 wherein the cathode is bonded to the permionic membrane.

9. A solid polymer electrolyte comprising an electrolyte impermeable, cation selective permionic membrane comprising fluorocarbon polymers having cation selective groups pendant thereto, anode means in contact with one surface thereof, and cathode means in contact with the opposite surface, said cathode means comprising an intercalation compound of graphite and a transition metal component.

10. A solid polymer electrolyte of claim 9 wherein the transition metal component is chosen from the group consisting of metals and chlorides thereof.

11. The solid polymer electrolyte of claim 10 wherein the transition metal component is chosen from the group consisting of copper, cadmium, mercury, cobalt, gold, iron, chromium, ruthenium, rhodium zirconium, hafnium, rhenium, palladium, platinum, iridium, tantalum, molybdenum, tungsten, chlorides thereof, and mixtures thereof.

12. The solid polymer electrolyte of claim 11 wherein the transition metal component is chosen from the group consisting of Co, $CoCl_2$, Cu, $CuCl_2$, Cr, $CrCl_3$, Fe, $FeCl_3$, Ni, $NiCl_2$, Pd, $PdCl_2$, Pt, $PtCl_4$, Rh, $RhCL_3$, Ru, $RuCl_3$, Ir, $IrCl_4$, and mixtures thereof.

13. The solid polymer electrolyte of claim 9 wherein the cathode means compressively bears upon the permionic membrane.

14. The solid polymer electrolyte of claim 9 wherein the cathode means are bonded to the permionic membrane.

15. In an electrolyte cell having an anode, a cathode, and a cation selective permionic membrane therebetween, the improvement wherein the cathode is bonded to the permionic membrane and comprises an inercalation compound comprising graphite and a transition metal component.

16. A solid polymer electrolyte comprising a permionic membrane, anode means in contact with one surface thereof, and cathode means in contact with the opposite surface, said cathode means being bonded to the permionic membrane and comprising an intercalation compound of graphite and a transition metal component.

* * * * *

UNITED STATES PATENT AND TRADEMARK OFFICE

CERTIFICATE OF CORRECTION

PATENT NO. : 4,336,123

DATED : June 22, 1982

INVENTOR(S) : Donald W. DuBois

It is certified that error appears in the above-identified patent and that said Letters Patent are hereby corrected as shown below:

At title page, under "OTHER PUBLICATIONS", first reference, "vol. 1" should read -- vol. 2 --.

In Claim 1, column 8, line 39, "polymer" should read --polymers--.

In Claim 11, column 9, line 15, "rhodium zirconium" should read --rhodium, zirconium--.

In Claim 12, column 10, line 1, "$RhCL_3$" should read --$RhCl_3$--.

Signed and Sealed this

*Twenth-eighth* Day of *September 1982*

[SEAL]

*Attest:*

GERALD J. MOSSINGHOFF

*Attesting Officer* *Commissioner of Patents and Trademarks*